US010807254B2

(12) United States Patent
Richards

(10) Patent No.: US 10,807,254 B2
(45) Date of Patent: Oct. 20, 2020

(54) ADJUSTABLE WALL TRIMMING DEVICE

(71) Applicant: Lee E. Richards, Whitefield, ME (US)

(72) Inventor: Lee E. Richards, Whitefield, ME (US)

( * ) Notice: Subject to any disclaimer, the term of this patent is extended or adjusted under 35 U.S.C. 154(b) by 0 days.

(21) Appl. No.: 14/875,724

(22) Filed: Oct. 6, 2015

(65) Prior Publication Data

US 2016/0121494 A1 May 5, 2016

Related U.S. Application Data

(60) Provisional application No. 62/075,562, filed on Nov. 5, 2014.

(51) Int. Cl.
*B26B 5/00* (2006.01)
*B26B 29/06* (2006.01)

(52) U.S. Cl.
CPC ..... *B26B 5/005* (2013.01); *B26B 29/06* (2013.01)

(58) Field of Classification Search
CPC ..... B26B 5/005; B26B 29/06; B44C 7/08
USPC ..... 30/2, 286–291, 293, 294, 314, 320, 339
See application file for complete search history.

(56) References Cited

U.S. PATENT DOCUMENTS 3,991,467 A * 11/1976 Yokoyama ..... B26B 5/005 30/293
4,064,626 A * 12/1977 Meshulam et al. ..... B26B 5/005 30/287
4,130,939 A * 12/1978 Toal ..... B26B 5/005 30/293
5,189,795 A * 3/1993 Fortin ..... B26B 5/005 30/287
5,450,672 A * 9/1995 Fortin ..... B26B 29/06 30/293
6,230,410 B1 * 5/2001 Taylor et al. ..... B26B 29/06 30/293
8,601,920 B2 * 12/2013 Edwards ..... B26B 5/005 30/293
2008/0172889 A1 * 7/2008 Nguyen et al. ..... B26B 5/005 30/287
2013/0061478 A1 * 3/2013 Lutgen et al. ..... B26B 5/003 30/160

* cited by examiner

*Primary Examiner* — Clark F Dexter
(74) *Attorney, Agent, or Firm* — Jeffrey Joyce, Esq.

(57) ABSTRACT

An easily adjustable trimming tool for precisely cutting the edge of carpeting and other types of sheet material. The tool is an easily grippable block that is constructed as a two-part molded plastic block, each part having molded ribs and reinforcing fastener bores that make for a lightweight, yet sturdy device that is economical to manufacture. Cutter assemblies and an adjustable heel allow for an easy adjustment to the length of the blade, so as to enable a long cut, standard cut, or short cut.

4 Claims, 6 Drawing Sheets

ADJUSTABLE WALL TRIMMING DEVICE

BACKGROUND INFORMATION

1. Field of the Invention

The invention relates to wall trimming devices.

2. Discussion of the Prior Art

U.S. Pat. No. 5,450,672 discloses a wall trimming tool for trimming flexible material, such as carpet, so that the material lies flat up against the wall. That disclosure is incorporated herein by reference, in its entirety. This prior art wall trimming tool is constructed of a solid block of wood, with a slot built in it to receive a blade and a blade holder that enables the length of the blade to be adjusted. The flexible material, such as, for example, floor covering, is placed in position to be cut and the trimming tool placed on top of the material, and is then pushed against the floor and simultaneously against the wall. The bottom of the block has a curved contour, and the flexible material conforms somewhat to this contour as the tool is pushed along the material. Moving the trimming tool along the flexible material while pushing against the wall provides the desired cut of the material, a cut that closely follows the contour of the wall.

The trimming device also includes a tool angle adjustment device that allows the user to change the angle of the trimming device relative the floor and wall surfaces, referred to as a "heel" adjuster. This adjuster allows the user to change the contact angle and position of the blade on the sheet material, thereby allowing a "standard cut" precisely along the wall, or a "short cut" that is in front of the wall. It cannot accommodate a "long cut", i.e. one in which the material extends under a baseboard or a wall. In some situations, for example, it is desirable to cut the sheet material just slightly short of the perfect fit. This is done to accommodate swelling of the sheet material in a humid environment.

The prior art device, being machined from a block of wood, is comparatively expensive to manufacture. The block material is expensive, as is the extensive machining that is required. A further disadvantage is that it is difficult to precisely adjust the blade. The process is cumbersome. First the blade is adjusted so that it just touches the floor, then the heel adjuster is set for the desired standard or short cut, which then may require that the length of the blade be adjusted again.

What is needed is a device that that is less expensive to manufacture and that is quickly and easily adjustable. What is further needed is such a device that enables a cut to be made with the desired closeness to the wall, whether that be a short cut, a standard cut, or a long cut.

BRIEF SUMMARY OF THE INVENTION

The invention is an adjustable trimming tool that is used to cut an edge of carpeting or other type of sheet material, so that the material fits perfectly against a wall or other fixture. The tool is configured so that a user can easily adjust the length of the cut, whether it be for a short cut, a long cut, or a standard cut against a wall. It is constructed of a two-part molded plastic component having a top half and a bottom half. Molded ribs and reinforcing bores are provided on each half. This construction produces a tool that is strong and durable, yet also economical to manufacture.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 6:
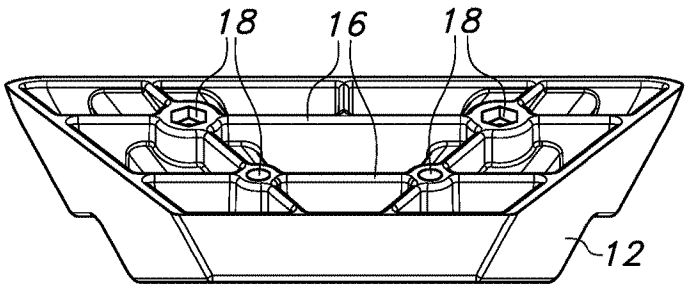
FIG. 6 is a perspective view of the mating surface of top half of block.
Figure 8:
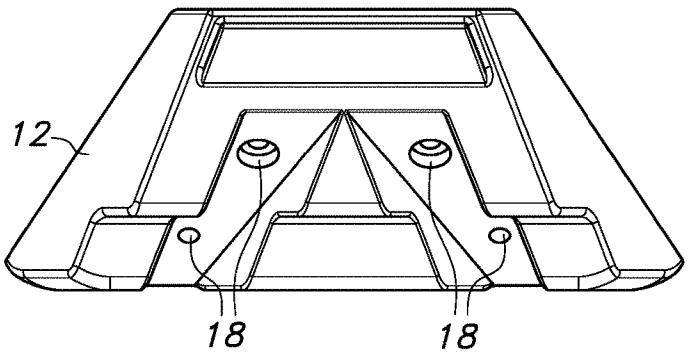
FIG. 8 is a plan view of the front of the block without blade adjusters.
Figure 5:
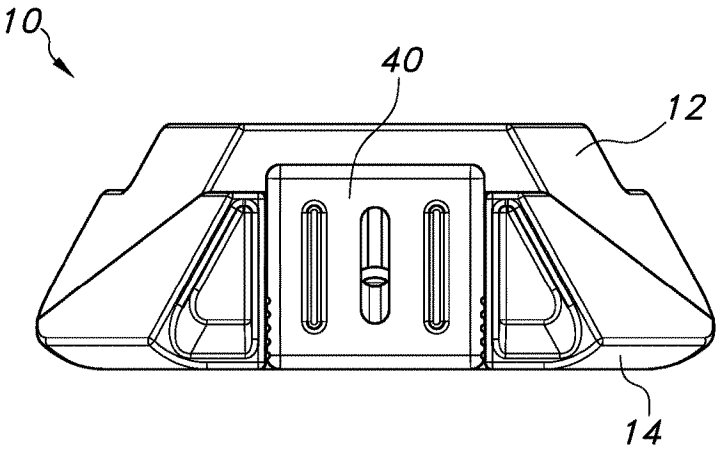
FIG. 5 is a rear plan view of the tool.
Figure 7:
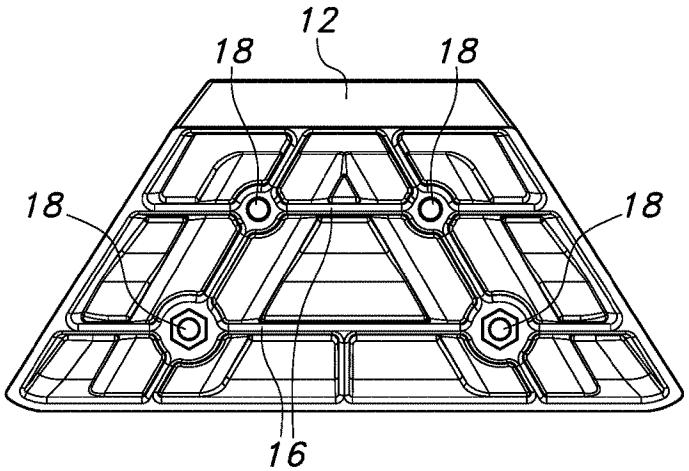
FIG. 7 is a plan view of the inside of the top half of the block.
Figure 10:
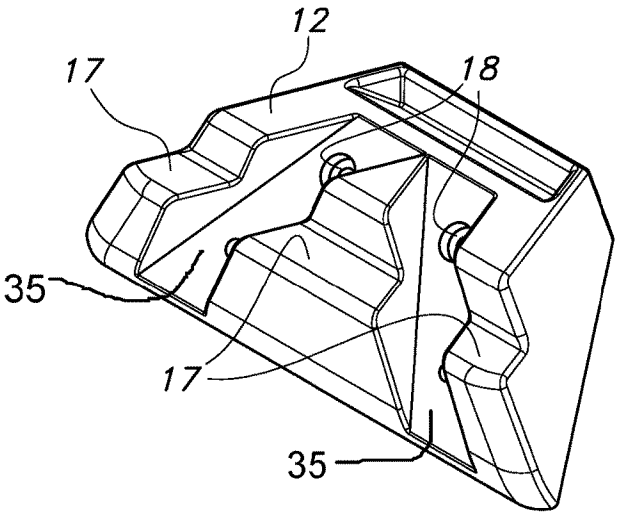
FIG. 10 is a perspective view of the top half of the block.
Figure 13:
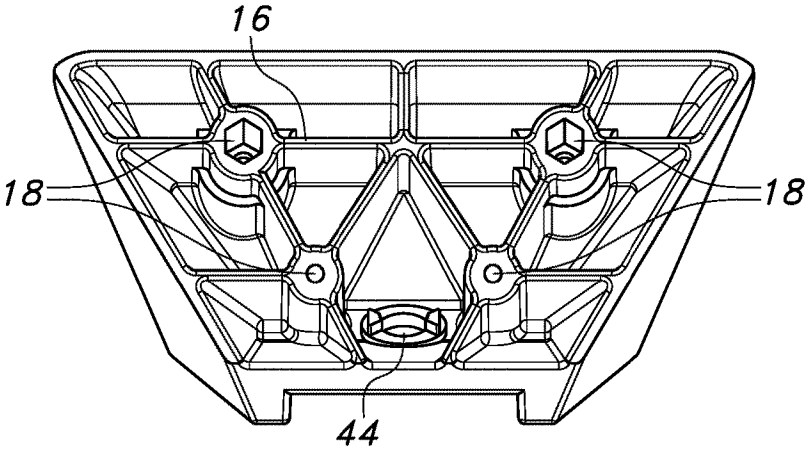
FIG. 13 is a perspective view of the mating surface of the bottom half of the block.

FIGS. 1, 2, 4, 5, 17, 19 and 20 illustrate an adjustable wall trimming tool 100 according to the invention that is used to cut an edge of carpeting or other type of sheet material, so that the carpet or sheet material fits perfectly whether the cut be a long cut that allows the sheet material to extend under the wall, a standard cut that is precisely along the wall, or a short cut that is a slight distance away from the wall. The wall trimming tool 100 is an easily grippable block 10 comprising a cutter assembly 30 with a blade and a tool angle modifier 40 that allows the user to adjust the tool 100 for a desired cut, such as a short or a long cut. The block 10 is constructed as a two-part molded plastic component having a top half 12 and a bottom half 14 that are fastened together by conventional fastening means. The block 10 has an ergonomic design that includes a number of grip recesses 17 that allow a user to comfortably hold and use the tool 100 with one hand and that also accommodates either a left or right hand grip. The block 10 is molded with ribs 16 and reinforced fastener bores 18, as shown in FIGS. 6, 7, and 13. The top and bottom halves 12, 14 have mating surfaces that are fastened together with fasteners (not shown). This construction is cost-effective, yet provides a tool that is lightweight and, therefore, easy to use, yet has the stiffness, ruggedness and durability that are desirable for cutting carpet or other types of thick sheet material.

FIGS. 6-10 illustrate various views of the top half 12 of the block 10, without the cutter assemblies 30. As can be seen in FIGS. 6 and 7, the top half 12 is a cored-out plastic molded component that is to a large extent hollow on the inside, with molded fastener holes 18 and reinforcing ribs 16. The reinforcing ribs 16 provide the necessary strength and rigidity and are designed to also reinforce the fastener bores 18. The fastener holes 18 receive fasteners 18*a* that fasten the top and bottom halves together along with the fasteners for the cutter assembly 30, shown in FIGS. 1, 17 and 20.

Figure 12:
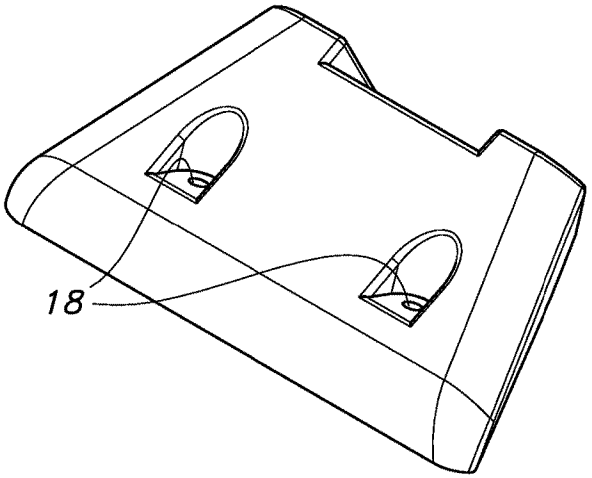
FIG. 12 is a perspective view of the bottom of the block.
Figure 9:
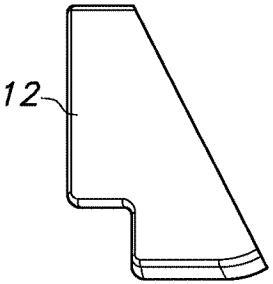
FIG. 9 is a side view of the top half of the block.
Figure 11:
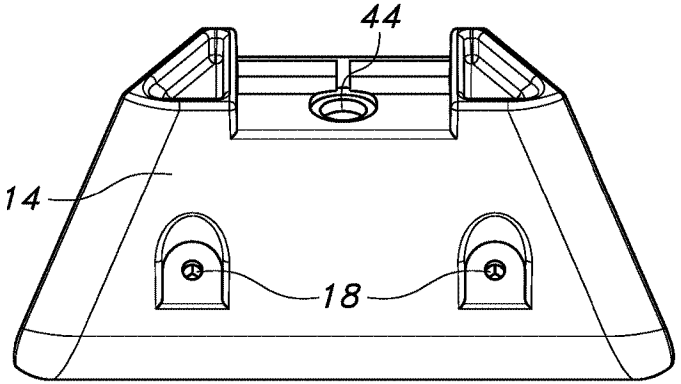
FIG. 11 is a perspective view of the bottom of the block.

FIGS. 11-13 illustrate the bottom half 14 of the tool 100, which is constructed similarly to the top half 12, described above, with reinforcing ribs 16 and mating fastener bores 18, including an insert bore 44 for receiving a threaded insert 44A.

Figure 2:
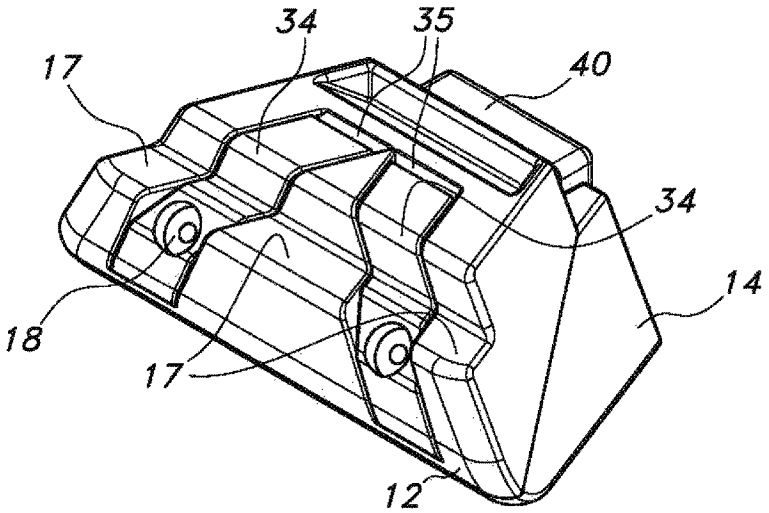
FIG. 2 is a perspective view of the tool.
Figure 4:
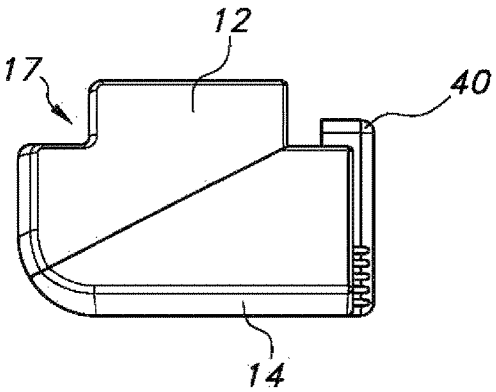
FIG. 4 is a side plan view of the tool.
Figure 1:
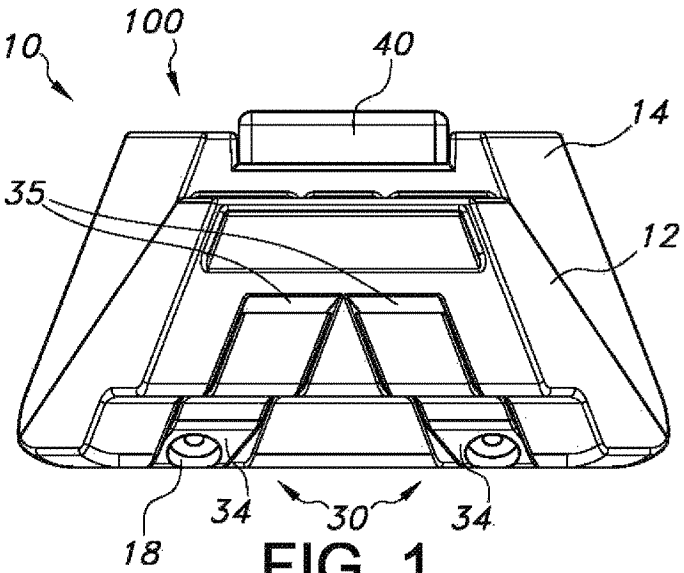
FIG. 1 is a top plan view of the wall trimming tool according to the invention.
Figure 3:
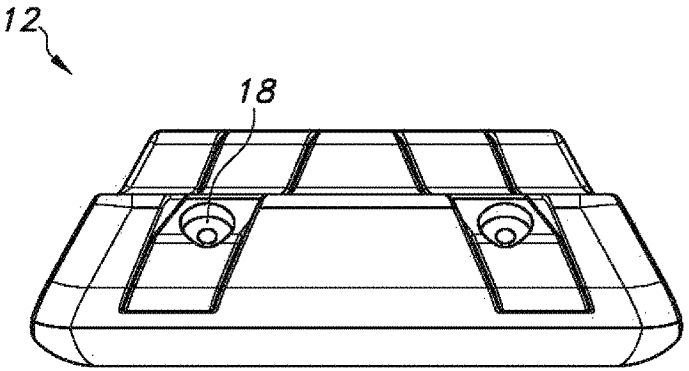
FIG. 3 is a front plan view of the tool.
Figure 14:
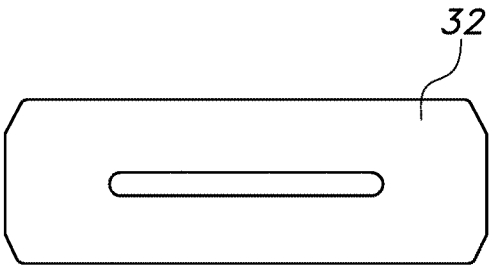
FIG. 14 is a plan view of the blade.
Figure 16:
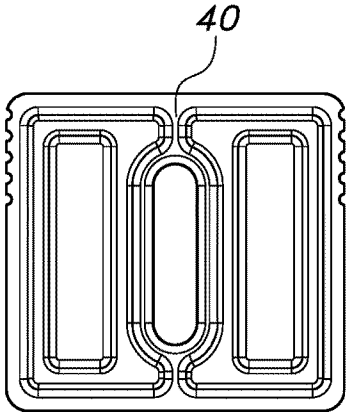
FIG. 16 is a plan view of the tool angle modifier.
Figure 15:
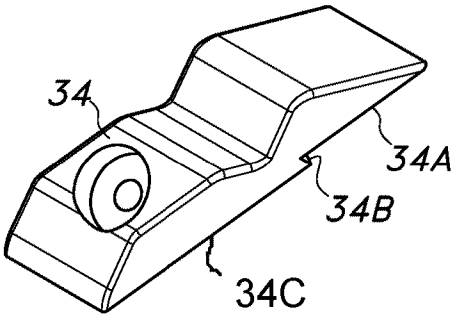
FIG. 15 is a perspective view of the blade hold-down.
Figure 18:
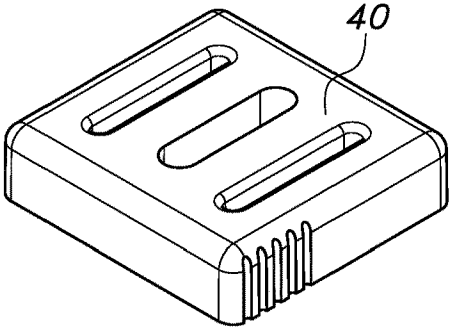
FIG. 18 is a perspective view of the tool angle modifier.
Figure 20:
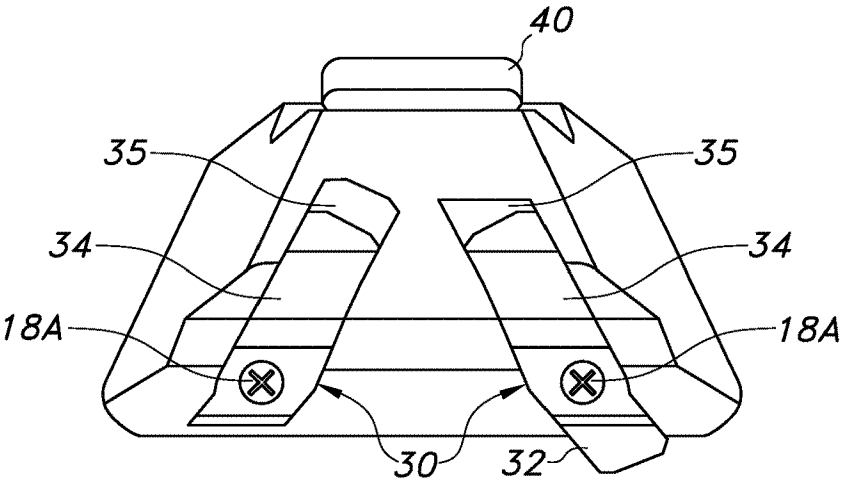
FIG. 20 is a front plan view of the tool.
Figure 17:
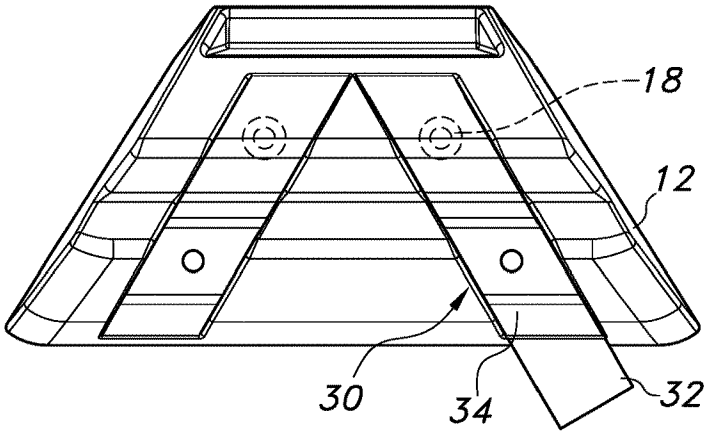
FIG. 17 is a plan view of the front of the tool.
Figure 21:
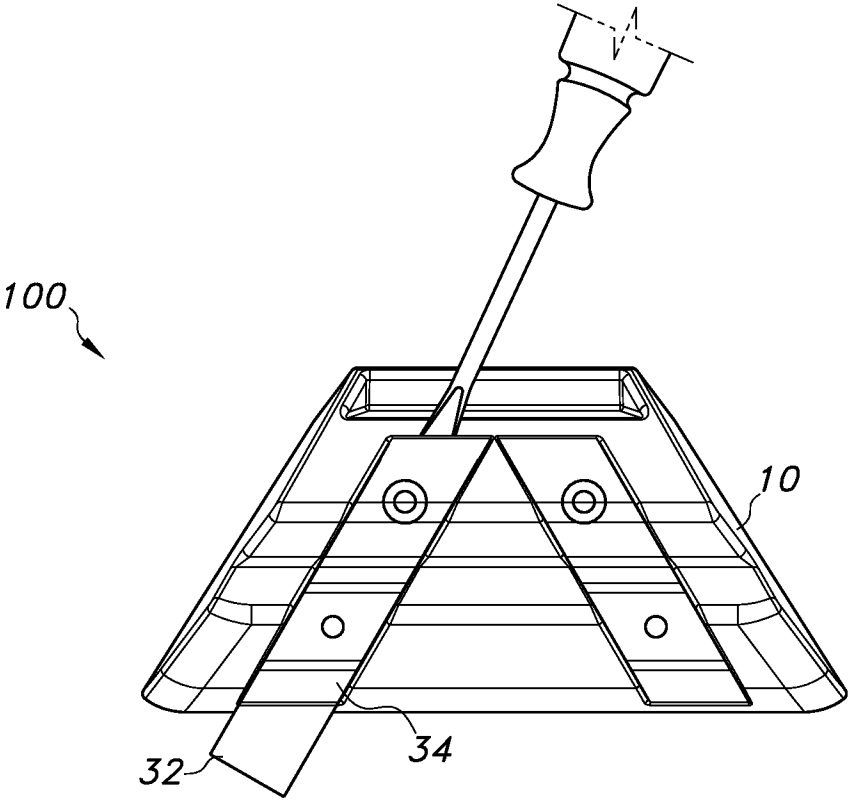
FIG. 21 illustrates a method of adjusting the blade in the blade hold-down.

The block 10 has a blade recess 35, shown in FIGS. 2 and 20, to receive the cutter assembly 30, which includes a blade 32 and a blade hold-down 34. In the embodiment shown, the block 10 includes two blade recesses 35. One or the other of the recesses is used, depending on whether the tool 100 is being pushed along the floor to the right or to the left. FIGS. 14 and 15 illustrate the blade 32 and the blade hold-down 34. The blade hold-down 34, which includes a blade clamping surface 34C, has a recessed surface 34A with a stop edge 34B that, when assembled in the blade recess 35 forms a stop edge. The user is able to set the length of the blade 32 to the proper cutting length by inserting a flathead screwdriver or other suitably shaped tool into the blade recess 35, as shown in FIG. 21, and pushing the blade 32 until the screwdriver comes into contact with the stop edge 34B and then tightening the fastener 18A to fix the blade hold-down 34 in that position. This blade adjustment is described below in greater detail, in the section describing use of the tool.

Figure 19:
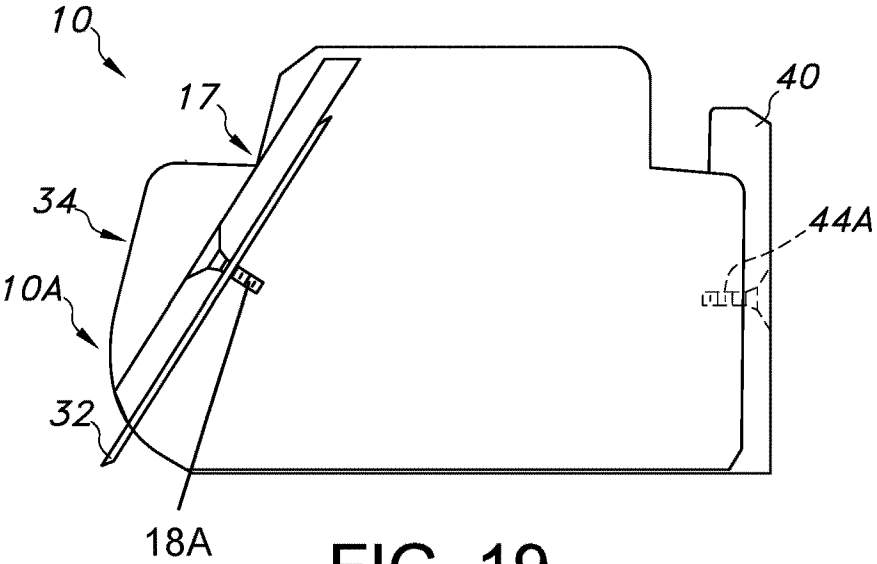
FIG. 19 is a side plan view of the tool.

FIGS. 2, 4, 5, 16, 18 and 19 illustrate the tool angle modifier or heel adjuster 40, which is fastened to a rear side of the block 10 by means of a threaded insert 44. This heel adjuster 40 is adjustable in the vertical plane, which, if set lower than the bottom surface of the block 10, changes the angle of the block relative the floor and the wall and, in this way, changes slightly the angle and position of the cut on the sheet material. The heel adjuster 40 is shown in FIG. 19 adjusted to be flush with the bottom surface of the block 10. Lowering the heel adjuster 40, so that it extends below the bottom of the block causes the tool 100 to tip forward. This in effect changes the angle of the blade 32 to a more vertical orientation and results in a "short" cut of the sheet material. It is also noted that the front surface of the block 10 has an angle that that has a slight slant 10*a* inward toward the block, to allow the tool 100 to be tipped forward, without changing the distance of the block from the wall.

Use of the tool 100: As mentioned above, cutting flooring isn't just a matter of cutting along the contour of the wall. Depending on the material, the ambient conditions, and the configuration of the wall, with or without baseboard, it may be desirable to make a standard cut, i.e., follow the contour of the wall exactly, or a short cut, i.e., cut slightly short of the wall, or a long cut, i.e., cut so that the material may extend under a baseboard or wall. The blade is adjusted accordingly. It is noted that the vertical distance between the front edge of the recess 35 and the flat bottom of the block 10 has been increased over that of the prior art device First, the user inserts the blade 32 into the recess 35 and loosely assembles the hold-down 34. The tip of a flat screwdriver is inserted into the space between the hold-down 34 and the recess 35, and pushed into the recess until the tip of the screwdriver hits the stop edge 34B on the hold-down 34. This sets the blade 32 so that the tip of the blade is just above the floor. Because of the greater vertical distance, this is the only adjustment needed for a long cut. If a short or standard cut is desired, then a second adjustment step is needed. The angle of the tool 100 may be modified to accommodate a short or-standard cut, without having to re-adjust the length of the blade 32. This simplifies the process of setting the tool for the perfect professional cut. If the sheet material is to be cut long, then no further adjustment is required, because the blade 32 is initially set to the correct length for a "long" cut. If the material is to be cut shorter, then the fastener securing the heel adjuster 40 is loosened and the heel dropped down so that it protrudes a small distance beyond the lower surface of the block 10. This tips the tool forward slightly, without changing the distance of the tool 100 to the wall, in other words, the user will always push the tool 100 up against the wall to make a cut, regardless of whether the cut is a short standard, or a long cut. Tipping the tool forward moves the cutting tip of the blade 32 away from its initial position slightly, thereby effecting a "shorter" cut. Once these two steps are completed, the tool 100 according to the invention is ready to be used. If the base of the wall includes molding, such as cove base, that must be cut at the same time as the sheet material then the user may extend the blade an additional ⅛ of an inch or so.

It is understood that the embodiments described herein are merely illustrative of the present invention. Variations in the construction of the wall trimming tool may be contemplated by one skilled in the art without limiting the intended scope of the invention herein disclosed and as defined by the following claims.

What is claimed is:

1. A wall trimming device for cutting sheet material to fit near, against, or under a wall, the wall trimming device comprising:

a plastic molded block having a top half and a bottom half that are fastened to each other, wherein the plastic molded block has an inside that is essentially a hollow construction with fastener holes and with reinforcing ribs that provide rigidity and also reinforce the fastener holes;

the plastic molded block having a front face that includes a blade recess, a front edge of the front face angled inward toward a lower surface of the block;

a cutter assembly mounted in the blade recess, the cutter assembly having a blade hold-down and a blade, the blade including a blade surface that is positioned between a top edge and bottom edge of the blade, the blade hold-down having a clamping surface and a recessed surface that ends at an edge of the clamping surface that forms a stop edge;

a tool angle modifier that is adjustably mounted on a rear face of the plastic molded block for adjusting an angle of the front face of the block relative to a cutting surface;

wherein the blade is adjustably mounted between the blade hold-down and the blade recess and wherein pushing the top edge of the blade until the top edge of the blade reaches the stop edge sets the bottom edge of the blade in a cutting position, the blade being secured in position by the clamping surface pressing the blade surface against a surface of the blade recess while the recessed surface remains spaced apart from the surface of the blade recess; and wherein the front edge of the front face has a vertical distance above the lower surface of the block for creating a long cut along the sheet material when the blade is set in the cutting position and the tool angle modifier is not adjusted and for creating a standard cut or a short cut when the tool angle modifier is adjusted to a position below the lower surface of the block.

2. The wall trimming device of claim 1, wherein the plastic molded block has one or more grip recesses.

3. The wall trimming device of claim 1, wherein the tool angle modifier is adjustably fastened to the plastic molded block by a threaded insert.

4. The wall trimming device of claim 1, wherein the plastic molded block includes a second blade recess and a second cutter assembly mounted in the second blade recess, the second cutter assembly having a second blade and a second blade hold-down having a second stop edge.

* * * * *